US008480264B2

(12) United States Patent
Vanden Eynden et al.

(10) Patent No.: US 8,480,264 B2
(45) **Date of Patent: *Jul. 9, 2013**

(54) LIGHTING APPARATUS WITH HEAT DISSIPATION SYSTEM

(71) Applicant: LSI Industries, Inc., Cincinnati, OH (US)

(72) Inventors: James G. Vanden Eynden, Hamilton, OH (US); James P. Sferra, Goshen, OH (US); Larry A. Akers, Clarksville, OH (US); John D. Boyer, Lebanon, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/736,222

(22) Filed: Jan. 8, 2013

(65) Prior Publication Data

US 2013/0120987 A1 May 16, 2013

Related U.S. Application Data

(63) Continuation of application No. 13/473,879, filed on May 17, 2012, now Pat. No. 8,382,334, which is a continuation of application No. 12/236,243, filed on Sep. 23, 2008, now Pat. No. 8,215,799.

(51) Int. Cl.
*F21V 29/00* (2006.01)

(52) U.S. Cl.
USPC ..... 362/294; 362/218; 362/249.01; 362/373

(58) Field of Classification Search
USPC ..... 362/218, 249.01, 249.02, 345, 547, 362/580, 373
See application file for complete search history.

(56) References Cited

U.S. PATENT DOCUMENTS

| | | | |
|---|---|---|---|
| D85,401 | S | 10/1931 | Stroud |
| 1,968,072 | A | 7/1934 | Creighton |
| D123,761 | S | 12/1940 | Pieper |
| D155,680 | S | 10/1949 | Baker |
| D165,259 | S | 11/1951 | Baker |
| 2,626,120 | A | 1/1953 | Baker |

(Continued)

FOREIGN PATENT DOCUMENTS

| | | |
|---|---|---|
| EP | 1950491 | 7/2008 |
| JP | D1303080 | 6/2007 |
| JP | 2007-220465 | 8/2007 |
| WO | WO2004/071143 | 8/2004 |

OTHER PUBLICATIONS

U.S. Appl. No. 29/337,217, filed May 18, 2009, Boyer.

(Continued)

*Primary Examiner* — John A Ward
(74) *Attorney, Agent, or Firm* — McDermott Will & Emery LLP

(57) ABSTRACT

A lighting apparatus is shown and described. In one aspect, the lighting apparatus includes a light source, a plate, and frame. The light source can include one or more lighting elements that are in thermal communication with the light source. The plate can have a dissipative portion extending outward from a point of thermal communication between the plate and the light source. The frame can at least partially enclose the light source and may also be in thermal communication therewith.

37 Claims, 9 Drawing Sheets

U.S. PATENT DOCUMENTS

D171,505 S 2/1954 Krueger
D171,866 S 3/1954 Schreckengost
2,675,466 A 4/1954 Baker
2,717,955 A 9/1955 McGinty et al.
D183,068 S 6/1958 Spaulding et al.
D188,212 S 6/1960 Ruppe
2,997,575 A 8/1961 Schwartz
3,069,540 A 12/1962 Jones
D212,899 S 12/1968 Vesely et al
3,560,728 A 2/1971 Atkins
3,588,488 A 6/1971 Lauterbach
D221,181 S 7/1971 Bobrick
3,735,329 A 5/1973 Funabashi et al.
D229,181 S 11/1973 Bledsoe
D234,800 S 4/1975 Swartz
4,155,608 A 5/1979 Orlewicz
4,170,077 A 10/1979 Pardes
4,302,801 A 11/1981 Duddy
4,375,106 A 2/1983 Voll
D272,475 S 1/1984 Yahraus
4,443,058 A 4/1984 Bosserman
4,530,010 A 7/1985 Billingsley
4,600,979 A 7/1986 Fisher et al.
4,707,595 A 11/1987 Meyers
4,862,334 A 8/1989 Ivey et al.
D304,860 S 11/1989 O'Dohanue et al.
D308,423 S 6/1990 Galipeau et al.
D312,842 S 12/1990 Younger et al.
4,977,323 A 12/1990 Jehle
4,982,092 A 1/1991 Jehle
RE33,572 E 4/1991 Meyers
5,012,112 A 4/1991 Flint
D319,513 S 8/1991 Vande Kieft
5,060,309 A 10/1991 Narita
D329,239 S 9/1992 Hahn
5,159,378 A 10/1992 Takada
5,183,328 A 2/1993 Osteen
5,196,926 A 3/1993 Lee
5,249,110 A 9/1993 Russello
5,282,121 A 1/1994 Bornhorst
D344,363 S 2/1994 Engle
D360,270 S 7/1995 Shemitz
D365,409 S 12/1995 Lu
5,497,207 A 3/1996 Kim
5,523,579 A 6/1996 Orlando
5,555,654 A 9/1996 Hermann
5,584,552 A 12/1996 Nam-Su
5,606,344 A 2/1997 Blaskey
5,696,564 A 12/1997 Hatakeyama
5,726,722 A 3/1998 Uehara et al.
5,758,956 A 6/1998 Bornhorst
D396,319 S 7/1998 Sutton
D397,472 S 8/1998 Lecluze
5,826,973 A 10/1998 Melzian et al.
5,829,868 A 11/1998 Hulton
D406,916 S 3/1999 Klaus
D410,562 S 6/1999 Hsu
D411,325 S 6/1999 Roorda
D411,326 S 6/1999 Roorda
5,949,081 A 9/1999 Ashley
6,011,640 A 1/2000 Hutton
6,062,704 A 5/2000 Holder
D427,343 S 6/2000 Reinbach
6,082,878 A 7/2000 Doubek et al.
6,188,507 B1 2/2001 Thomas
6,210,024 B1 4/2001 Shida
6,265,662 B1 7/2001 Riedy et al.
6,350,041 B1 2/2002 Tarsa et al.
6,361,173 B1 3/2002 Vlahos
6,425,678 B1 7/2002 Verdes
6,480,389 B1 11/2002 Shie
6,481,874 B2 11/2002 Petroski
6,525,814 B1 2/2003 Hendrick
6,623,144 B2 9/2003 Bornhorst
6,626,562 B2 9/2003 Blanchard
6,635,892 B2 10/2003 Kelly
6,703,631 B2 3/2004 Suzuki
6,742,901 B2 6/2004 Kimura
6,769,792 B1 8/2004 Bornhorst
6,773,119 B2 8/2004 Kimura
6,773,138 B2 8/2004 Coushaine
D496,487 S 9/2004 Rhee
6,787,999 B2 9/2004 Stimac
6,793,349 B2 9/2004 Hooper
6,793,353 B2 9/2004 Kimura
6,799,853 B2 10/2004 Silverbrook
6,827,454 B2 12/2004 Kimura
6,871,983 B2 3/2005 Jacob et al.
6,964,499 B2 11/2005 Colip et al.
D514,248 S 1/2006 Rhee
6,982,518 B2 1/2006 Chou
7,008,095 B2 3/2006 Coushaine et al.
7,064,498 B2 6/2006 Dowling
D524,555 S 7/2006 Mohundro
7,075,224 B2 7/2006 Coushaine
7,084,405 B1 8/2006 Malyutenko
7,093,958 B2 8/2006 Coushaine
D528,226 S 9/2006 Nagai et al.
7,111,963 B2 9/2006 Zhang
D530,808 S 10/2006 Sinur et al.
D532,143 S 11/2006 Woertler
D532,544 S 11/2006 Woertler
7,146,760 B2 12/2006 Yiu
D535,774 S 1/2007 Weston et al.
7,166,955 B2 1/2007 Coushaine
7,186,010 B2 3/2007 Coushaine et al.
D547,482 S 7/2007 Blackman
D547,484 S 7/2007 Guercio
D549,869 S 8/2007 Ward
D551,379 S 9/2007 Maxik
D551,382 S 9/2007 Curtin et al.
7,275,841 B2 10/2007 Kelly
D558,382 S 12/2007 Cesaro
D558,388 S 12/2007 Ward
D559,553 S 1/2008 Mischel, Jr.
D559,557 S 1/2008 Mischel, Jr.
D565,207 S 3/2008 Uemoto et al.
D565,755 S 4/2008 Uemote et al.
D567,989 S 4/2008 Goetz-Schaefer
D572,858 S 7/2008 Santoro
D574,994 S 8/2008 Boyer
D579,598 S 10/2008 Santoro
7,434,964 B1 10/2008 Zheng et al.
7,494,248 B2 2/2009 Li
7,494,249 B2 2/2009 Li
D592,348 S 5/2009 Trott et al.
D598,160 S 8/2009 Boyer
D598,161 S 8/2009 Boyer
D603,081 S 10/2009 Boyer et al.
D611,188 S 3/2010 Boyer et al.
7,959,332 B2 6/2011 Tickner et al.
7,993,034 B2 8/2011 Wegner
8,070,328 B1 12/2011 Knoble et al.
8,215,799 B2 7/2012 Vanden Eynden et al.
8,382,334 B2 * 2/2013 Vanden Eynden et al. ... 362/294
2002/0093820 A1 7/2002 Pederson
2004/0052077 A1 3/2004 Shih
2004/0120156 A1 6/2004 Ryan
2005/0024870 A1 2/2005 Coushaine
2005/0180142 A1 8/2005 Tsai
2006/0056169 A1 3/2006 Lodie et al.
2006/0087843 A1 4/2006 Setomoto et al.
2006/0274529 A1 12/2006 Cao
2007/0098334 A1 5/2007 Chen
2007/0109795 A1 5/2007 Gabrius
2007/0147047 A1 6/2007 Wu
2007/0153548 A1 7/2007 Hamada
2007/0230172 A1 10/2007 Wang
2007/0247850 A1 10/2007 Hawkins et al.
2008/0007953 A1 1/2008 Keller et al.
2008/0186704 A1 8/2008 Chou
2009/0002997 A1 1/2009 Koester
2010/0046227 A1 2/2010 Knoble et al.
2010/0073930 A1 3/2010 Vandeneynden et al.
2010/0085746 A1 4/2010 Zheng
2010/0085752 A1 4/2010 Zheng
2010/0165627 A1 7/2010 Wung et al.

| | | | |
|---|---|---|---|
| 2010/0188845 | A1 | 7/2010 | Rooms et al. |
| 2010/0202144 | A1 | 8/2010 | Chen |
| 2010/0254134 | A1 | 10/2010 | McCanless |

OTHER PUBLICATIONS

International Search Report and Written Opinion dated Apr. 21, 2010 from PCT Application No. PCT/US2009/057807.
Response to the International Search Report and Written Opinion dated Apr. 21, 2010 from PCT Application No. PCT/US2009/057807.
Office Action dated Jan. 20, 2011 from corresponding Taiwan Application No. 099303631.
Australian Patent Application No. 2009298917, Examination Report, dated Aug. 31, 2011, Intellectual Property Office Australia.
Response to Office Action dated May 5, 2011 from corresponding European Application No. 09792833.7.
Beta LED Delivers The Edge, 2007, Beta Lighting; pp. 1-5.
BLD-PKG-T5-DM, The Edge Parking Structure Light, Feb. 29, 2008; pp. 1-2.
BLD-CAN-T5-DM, The Edge Canopy Light, Feb. 8, 2008; pp. 1-2.
BLD-SEC-T2-WM, The Edge Wall Pack, Feb. 29, 2008, pp. 1-2.
Encore from LSI Petroleum Lighting, 2004; pp. 1-10.
Encore Top Access—Flat Lens, LSI Petroleum Lighting, 2007; pp. 1-2.
Encore Top Access—Flat Lens Focus LSI Petroleum Lighting, 2007, pp. 1-2.
Vandal Proof Recessed 1×1 LSI Industries, Inc., 2007; pp. 1-2.
Sovereign, LSI Petroleum Lighting, 2007; pp. 1-2.
Office Action dated Jan. 18, 2011 from Corresponding Chinese Application No. 200910173529.2. English translation attached.
Response dated Mar. 17, 2011 to Office Action dated Jan. 18, 2011 from Corresponding Chinese Application No. 200910173529.2.
Office Action dated Feb. 22, 2012 from Corresponding Chinese Application No. 200910173529.2.
Response dated Aug. 8, 2012 to Office Action dated Feb. 22, 2012 from Corresponding Chinese Application No. 200910173529.2.
Examination Report dated Mar. 30, 2012 from Corresponding New Zealand Application No. 591472.
Response dated Jul. 12, 2012 to Examination Report dated Mar. 30, 2012 from Corresponding New Zealand Application No. 591472.
Examination Report dated Jul. 17, 2012 from Corresponding New Zealand Application No. 591472.
Response dated Aug. 9, 2012 to Examination Report dated Jul. 17, 2012 from Corresponding New Zealand Application No. 591472.
Response dated Jul. 12, 2012 to Examination Report dated Aug. 30, 2011 from Corresponding Australian Application No. 2009298917.
Office Action dated Nov. 26, 2012 from Corresponding Chinese Patent Application No. 200910173529.2.
Office Action dated Jan. 24, 2013 from Corresponding Japanese Patent Application No. 2011-528059.
Office Action dated Jan. 2, 2013 from Corresponding European Patent Application No. 09792833.7.

* cited by examiner

LIGHTING APPARATUS WITH HEAT DISSIPATION SYSTEM

This application is a continuation application of U.S. patent application Ser. No. 13/473,879 filed May 17, 2012, currently pending, which is a continuation of U.S. patent application Ser. No. 12/236,243 filed Sep. 23, 2008, and now U.S. Pat. No. 8,215,799.

FIELD OF THE DISCLOSURE

The present disclosure relates generally to a lighting apparatus. More specifically, the disclosure relates to various structures facilitating heat dissipation in a lighting apparatus.

BACKGROUND OF THE DISCLOSURE

When designing and implementing lighting apparatuses, generation of heat is one of many factors to be contemplated. In lighting apparatuses, light sources can create heat which may not be desirable to the functionality of the apparatus. Excess heat may result in melting of components, malfunctioning of proximate devices, or otherwise undesirable results. Also, excessive heat may diminish the efficiency or the lifespan of components within a lighting apparatus. Correspondingly, cooler operating temperatures may increase effectiveness of components within a lighting apparatus.

Heat can be transferred in three ways: convection, conduction, and radiation. These three methods of heat transfer can be harnessed to transfer heat away from a lighting apparatus, if the existence of such heat is undesirable.

SUMMARY OF THE DISCLOSURE

In one aspect, the disclosure presents a lighting apparatus that can include a light source, a plate, and a frame. The light source can include one or more lighting elements. The plate can be in thermal communication with the light source and have a dissipative portion that extends outward from the point of thermal communication between the plate and the light source. The frame can at least partially enclose the light source. The frame can also be in thermal communication with one of the plate or the light source and have a footprint that fits substantially within the plate.

In various embodiments, a lighting element can be a light emitting diode mounted on a printed circuit board. The lighting apparatus can also include a housing in communication with a portion of the plate. The housing can create a volume that houses the plate and the light source.

In one embodiment, the plate and frame are constructed of sheet metal. The plate can be in direct contact with a surface of the light source. In another embodiment, the lighting apparatus includes a lens that covers at least a portion of the light source.

In another aspect, the disclosure presents a lighting apparatus having a light source, a plate and a frame. The light source can include one or more lighting elements. The plate can have a dissipative portion defining an outermost perimeter of the plate. The frame can at least partially enclose the light source. The frame can be in thermal communication with at least one of the plate or the light source. The frame can also have an outer perimeter substantially within the outermost perimeter of the plate. The dissipative portion extends away from the point of thermal communication with the frame.

In another aspect, the lighting apparatus includes a light source, a plate, and frame. The light source can include one or more lighting elements. The plate can have a dissipative portion extending outward from a point of thermal communication between the plate and the light source. The frame can at least partially enclose the light source and may also be in thermal communication therewith.

DETAILED DESCRIPTION OF THE DISCLOSURE

Figure 1:
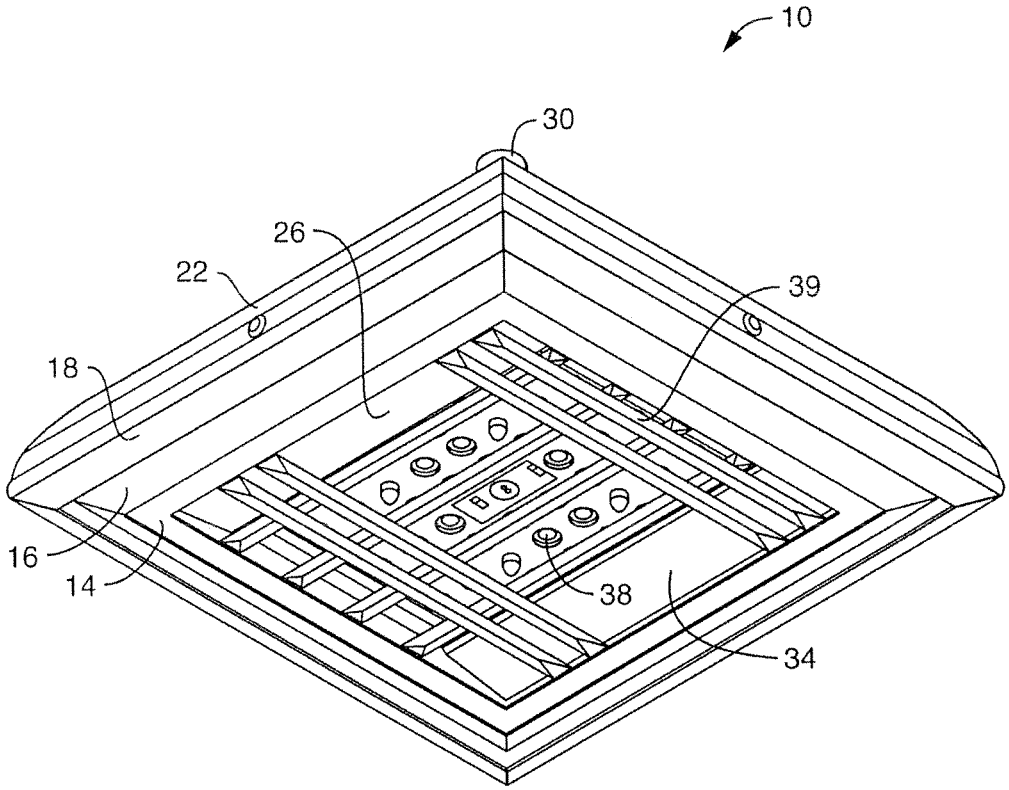
FIG. 1 shows a perspective view of an embodiment of a lighting apparatus.
Figure 2:
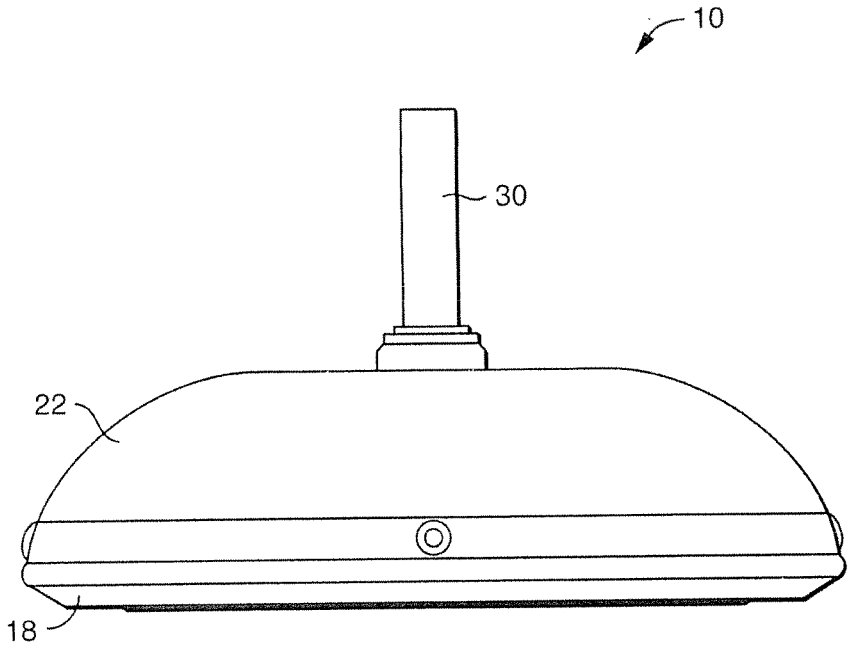
FIG. 2 shows a side view of the lighting apparatus of FIG. 1.

The present disclosure describes a heat dissipation system for use in lighting apparatuses. Aspects and embodiments of the present disclosure provide lighting apparatuses and heat dissipation systems for those apparatuses. By placing lighting elements and other heat producing sources in thermal communication with heat conductive materials, heat can be transferred away from lighting elements and surrounding structure to other areas of the light apparatus, including the heat dissipation system which facilitates a high rate of heat dissipation. Further, the surface area, location, and orientation of the heat dissipating materials, quickly and efficiently dissipate heat. Strategic location of the heat dissipation system components facilitates efficient radiation as well as convection.

Referring now to FIGS. 1-3A, an embodiment of a lighting apparatus 10 is shown and described. The lighting apparatus 10 includes a frame 14, a plate 18, a housing 22, a light source 26, a fixing mechanism 30, and a lens 34. The light source 26 includes a plurality of lighting elements 38. The light source 26 is in thermal communication, as defined below, with the plate 18. The frame 14, which, as shown, partially encloses the light source, is in thermal communication with the plate 18 and the lens 34. The housing 22 is in thermal communication with the plate 18. The fixing mechanism 30 is attached to the housing 22 and facilitates mounting of the lighting apparatus in a desired location.

In one embodiment, the frame 14 is roughly square in shape and partially encloses the light source 14 on four sides. The frame 14 in conjunction with the plate 18 and the lens 34 encloses the light source 26 on all sides, with necessary access for wiring, attachment mechanisms, and the like. The frame 14, in various embodiments, can also have a different shape. One example of a frame with a different shape is shown with reference to FIG. 4. Depending on the application, other examples of the shape of the frame 14 include, but are not limited to, rectangular, circular, or other shape that permits partial enclosure of the light source 26. The frame 14 is in thermal communication with at least one of the plate 18, the light source 26, or both. The frame 14 is also in thermal communication with the lens 34. In various embodiments, the heat dissipation system of the present disclosure can be, but is not necessarily, practiced without a lens 34. The frame 14 shown in FIG. 3A is wider at its thermal communication with the plate 18, which defines an outer perimeter, than it is at the thermal communication with the lens 34, which defines a lens perimeter. This change in width creates an inwardly sloped portion 16 of the frame 14. In other embodiments, the frame 14 can have an outwardly sloped portion, a perpendicular extension from the plate 18 with no slope, or other protrusion.

In one embodiment, the light source 26 comprises at least one lighting element 38. Possible lighting elements 38 include incandescent light bulbs, fluorescent lights, light emitting diodes (LEDs), organic LEDs (OLEDs), and other commercially or non-commercially available light emanating components.

In one embodiment, LEDs are fabricated or mounted onto a printed circuit board (PCB). The LEDs can be of any kind, color (i.e. emitting any color or white light or mixture of colors and white light as the intended lighting arrangement requires) and luminance capacity or intensity, preferably in the visible spectrum. One or more PCBs are in thermal communication with the plate 18. The lighting elements 38 on the PCB emanate light that radiates through the lens 34. In one embodiment, the lighting apparatus can be used with Nichia NSW6-083x and/or Osram LUW W5AM xxxx xxxx LEDs.

In an alternative embodiment, the present disclosure relates to a lighting apparatus having a light source 26, a plurality of light elements 38, and a plurality of reflectors 39, as described in co-pending U.S. provisional patent application 60/980,562, filed Oct. 17, 2007 incorporated herein by reference in its entirety.

The plate 18 can be roughly square in shape and can be substantially flat in the area in thermal communication with the housing 22. The plate 18, in various embodiments, can be in thermal communication with the one of the frame 14 or light source 26. The thermal communication between the plate 18 and the frame 14 can, in another embodiment, occur via the light source 26. The plate 18 can also have a different shape. For example, depending on the application, the shape of the plate 18 can be, but is not limited to being, rectangular, circular, or other shape. Furthermore, the plate 18 can also have vertical shape, instead of being substantially flat. For example, the plate 18 can be, but is not limited to being, curved, s-shaped, or otherwise bent. The plate 18 has an outermost perimeter, which is the perimeter of the plate 18 in a plane parallel to the light source 26, lens 34, or frame 14 and at its outermost position. As shown, the outermost perimeter of the plate is the widest perimeter of the point of thermal communication between the plate 18 and the housing 22. In an alternate embodiment, the plate 18 has a base 43 that is substantially the same size as its point of contact with the housing 22, and, at the outer perimeter of the frame, a dissipative portion of the plate 18 protrudes away from the housing 22 and extends to be substantially parallel to the inwardly sloped portion 16 of the frame 14. As is described below, this parallel protrusion permits for an angling of the heat dissipation surface towards cooler areas. Alternatively, the plate base 43 and the protruding dissipative portion 46 of the plate 18 can be two separate pieces in thermal communication. The frame 14 has an outer footprint perimeter located at the thermal communication between the frame 14 and the plate 18. The outer footprint perimeter is substantially within the outermost perimeter defined by the plate 18. Alternatively, the frame 14 outer footprint perimeter, in various embodiments, can be, but is not limited to being, partially outside the outermost perimeter of the plate 18.

In the embodiment shown in FIGS. 1-3A, the housing 22 is in thermal communication with the plate 18 and the fixing mechanism 30. At the point of thermal communication with the plate 18, the housing 22 is roughly in the shape of a square. The housing 22, in various alternative embodiments, can take different shapes at the point of thermal communication with the plate 18. For example, the shape can be, but is not limited to, rectangular, circular, or other shape.

The fixing mechanism 30 facilitates mounting and positioning the light source 26. The fixing mechanism 30 is configured to house necessary electrical wiring for operation of the lighting apparatus 10, such as power wires. The fixing mechanism, for example, can transport wiring to the housing 22 so as to cover and/or contain components such as a power supply, regulator, driver circuits or other desired components/circuits to operate the light apparatus. In one embodiment, the fixing mechanism 30 is a pipe.

The fixing mechanism 30, in various embodiments, can take any shape, size, or form. Further, in various embodiments, the fixing mechanism 30 can be constructed using different materials, such as, but not limited to, plastic, metal, or rubber. In such embodiments, the fixing mechanism may or may not dissipate heat through cooperation with the other components of the lighting apparatus 10. Furthermore, the fixing mechanism 30 can be in releasably affixed to the housing 22. Alternatively, the fixing mechanism 30 can be merged to be one single contiguous piece with the housing 22. The fixing mechanism 30 can have an axis, and that axis running perpendicular to the plate 18, as shown in FIGS. 1-3A, or, alternatively, parallel to the plate 18, as shown in FIG. 4.

In various embodiments of the present disclosure, one or more components of the lighting apparatus 10 in communication with each other can be releasably connected. For example, the plate 18 base in communication with the housing may be a piece separate from the protrusion of the plate 46 away from the housing 22. In another example, the frame 14 can be manufactured to be one single contiguous piece with the plate 18. Similarly, the plate 18 can be one single contiguous piece with the housing 22. Various other combinations of separating components and merging components are also contemplated.

As shown, the shape of the housing 22 is roughly a square-bottomed (as shown in FIG. 1) dome with a flattened top. In various embodiments, the housing can take many shapes. For example, the shape of the housing 22 can be, but is not limited to being, a circular dome, a cone, a cube, or other shape.

Figure 3:
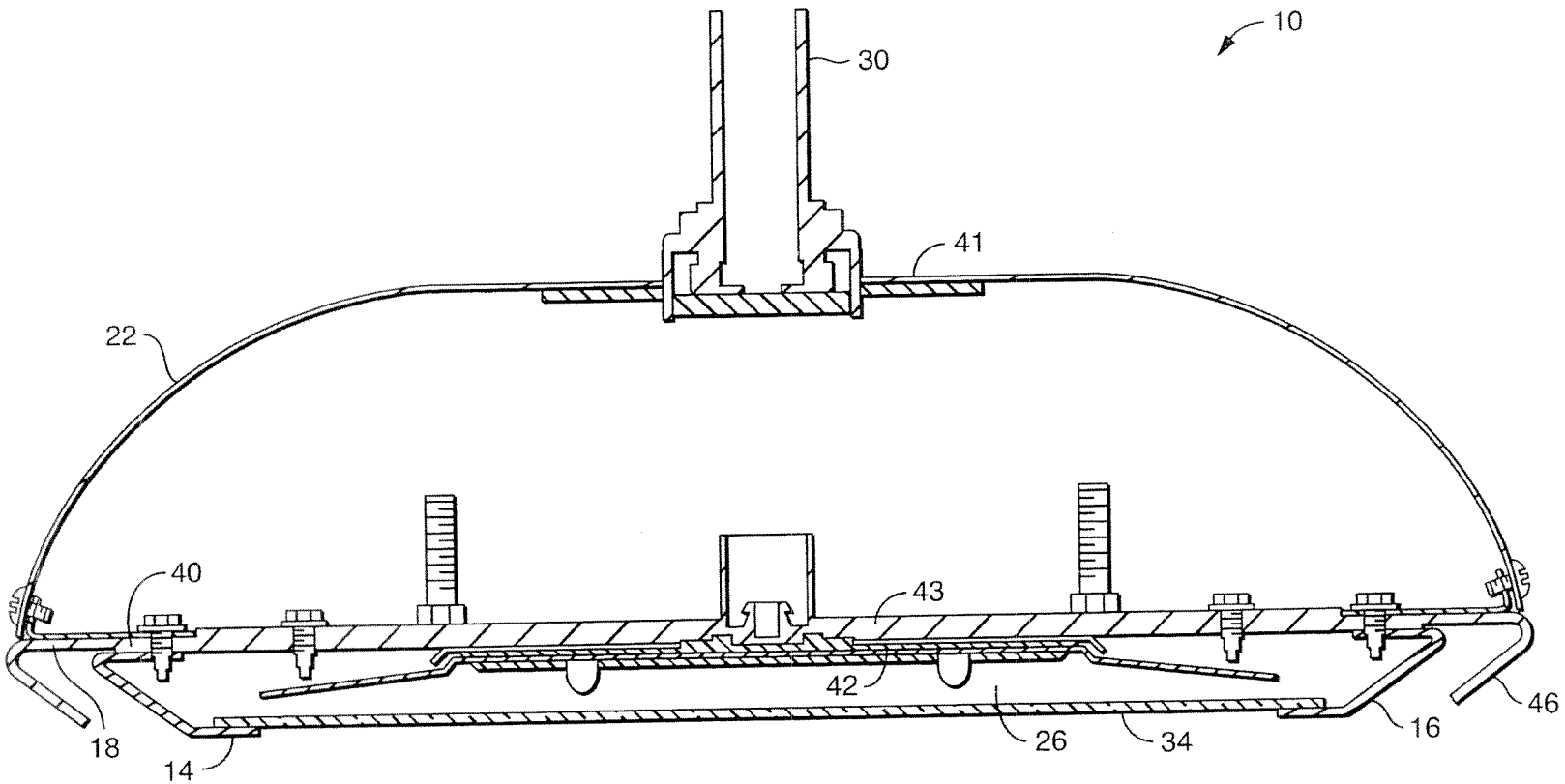
FIG. 3 shows a cross-sectional view of the lighting apparatus of FIG. 1.
Figure 3A:
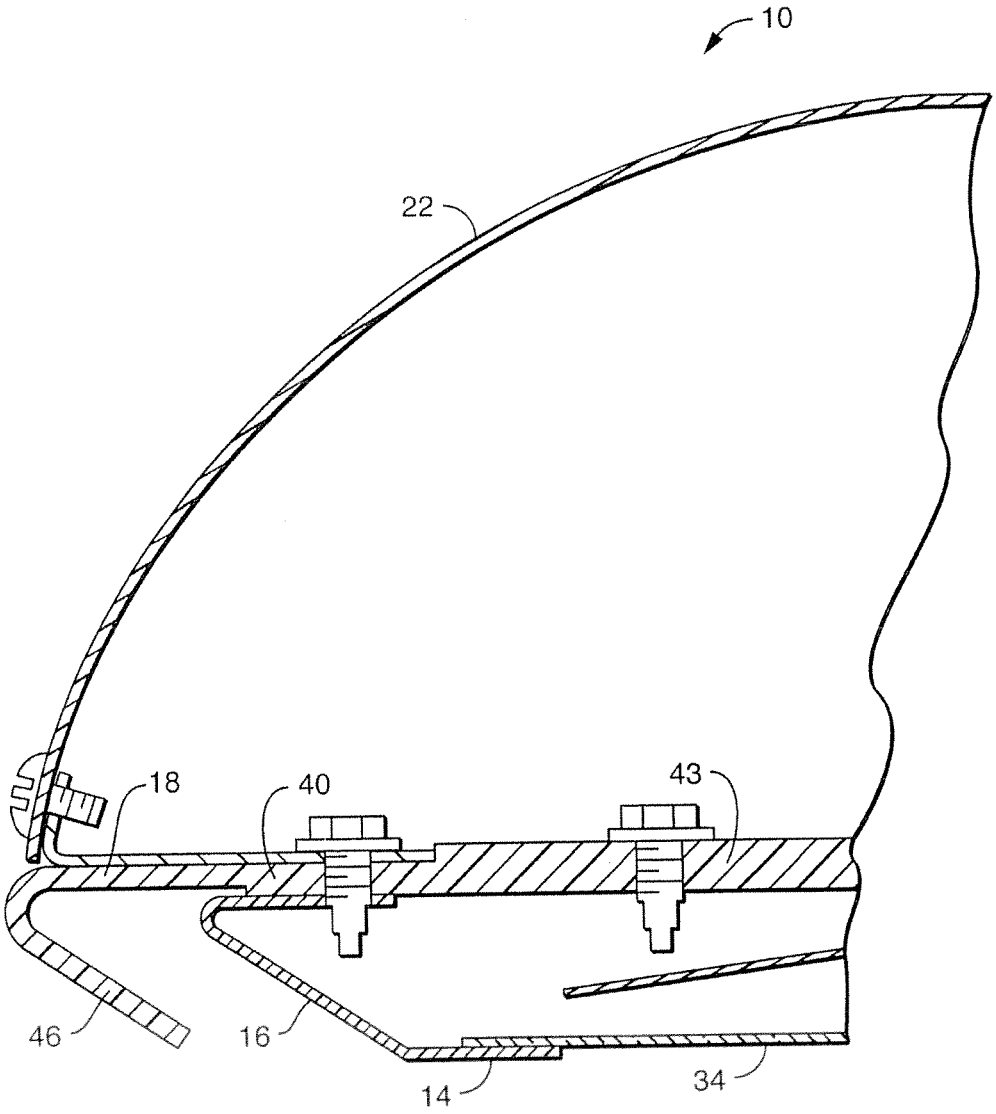
FIG. 3A shows an enlarged, detailed view of a portion of FIG. 3.
Figure 4:
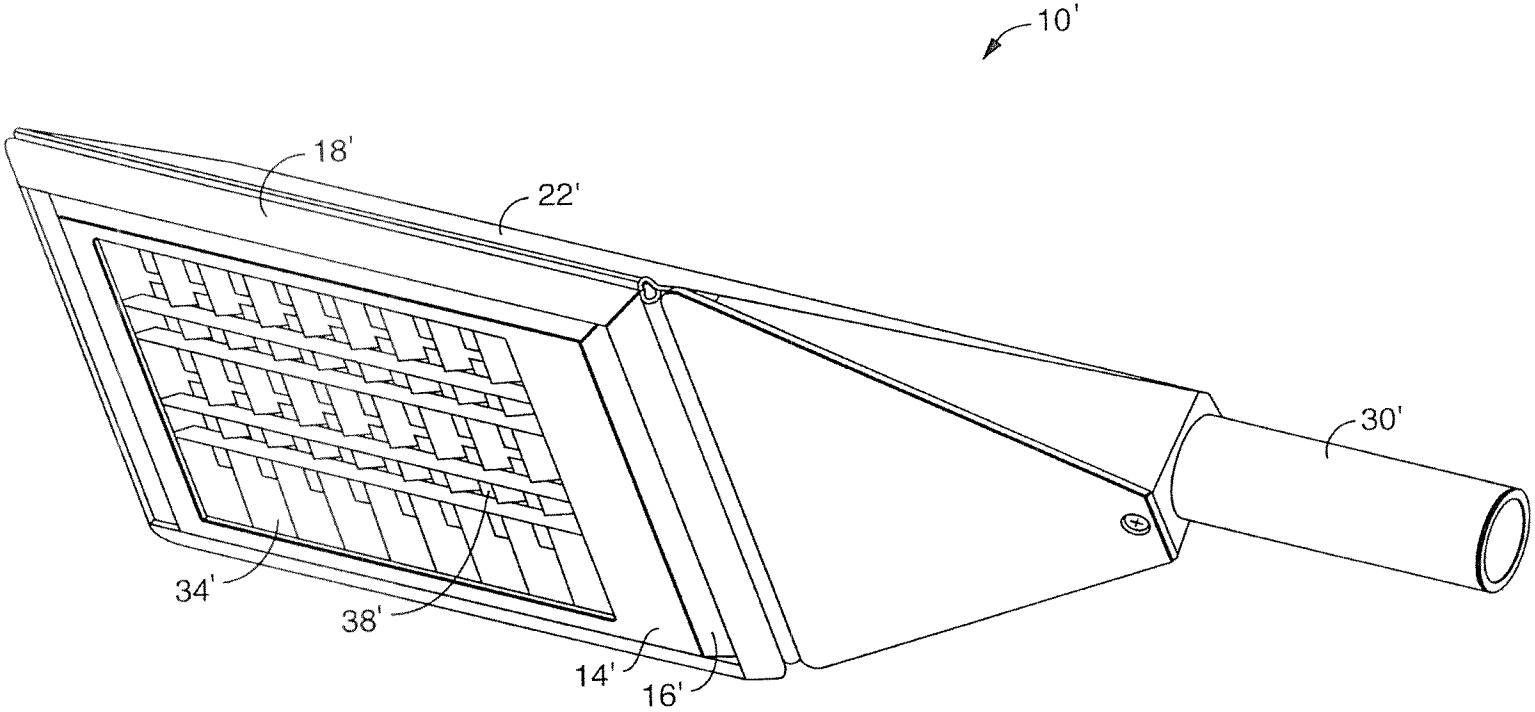
FIG. 4 shows a perspective view of another embodiment of a lighting apparatus.

As shown in FIGS. 3 and 3A, the thermal communication between the frame 14 and the plate 18 occurs via direct contact resulting from mounting the frame 14 and the plate 18 at contact 40. This direct contact 40 facilitates thermal communication between the plate 18 and the housing 22. Thermal communication between the housing 22 and the fixing mechanism 30 also occurs via direct contact 41. In various embodiments, the thermal communication can take other forms. For example, the thermal communication between any pair of components can be, but is not limited to the inclusion of, a rubber gasket, an adhesive, polyurethane, or other material between the various components of the lighting apparatus 10. For example, a gasket can be, but is not limited to, a SikaTack-Ultrafast polyurethane gasket manufactured by Sika Corporation. The materials of each of the components may have the same heat transfer characteristics. Alternatively, different materials can be used having varying thermal transfer properties and thus transfer more or less heat.

Also, in various embodiments, the surface areas of the various components can be increased to effect the thermal transfer properties. For example, the housing 22 can be dimpled. Also, "fins" (not shown) can be added to one or more of the components. The fins can be protrusions extending in various directions from the respective components.

Figure 7:
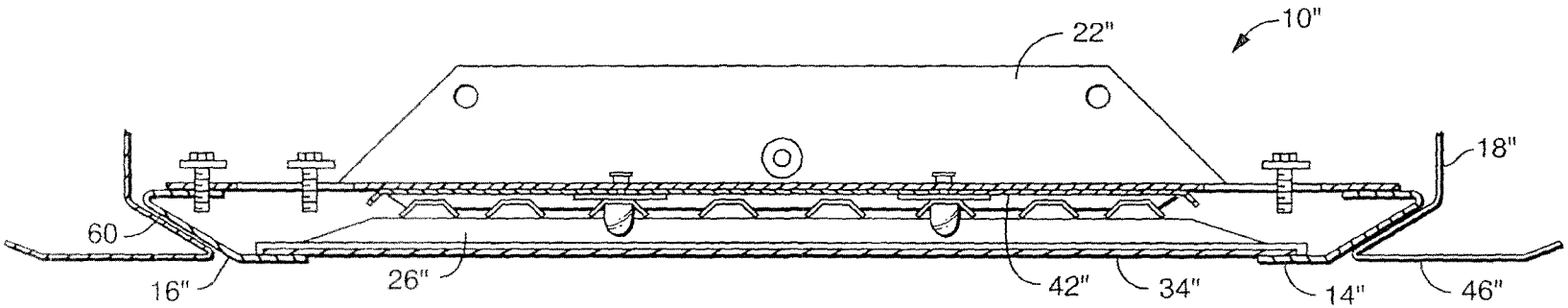
FIG. 7 shows a cross-sectional view of the lighting apparatus of FIG. 6.
Figure 7A:
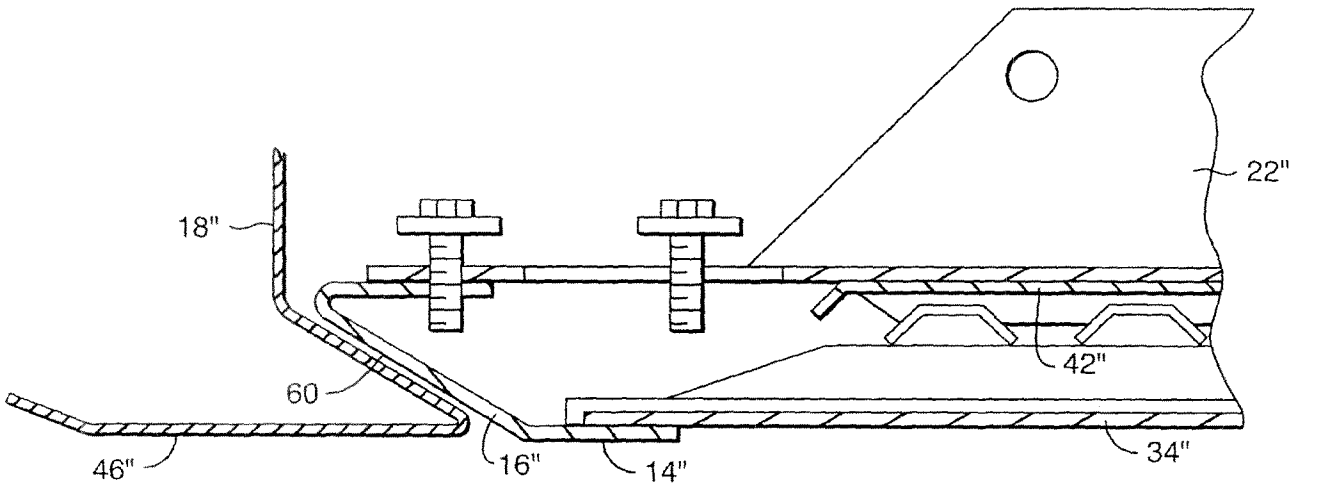
FIG. 7A shows an enlarged, detailed view of a portion of FIG. 7.

The thermal transfer during operation of the lighting apparatus 10 is now discussed. The light source 26 produces heat. This heat is transferred from the light source 26 to the plate 18. This transfer can occur via conduction, convection or radiation depending on the mode of thermal communication between the plate 18 and the light source 26. In one embodiment, this heat is produced by light elements 38, such as, but not limited to, LEDs and, correspondingly, the PCB, driver, power regulator, and components of the light apparatus. In such an embodiment, the heat from the LEDs is transferred via a PCB, or other element on which the LEDs are mounted, to the plate 18. The heat transmits through the plate 18 to several points. Heat is carried to the frame primarily by conduction at direct contact 40. Heat also transmits through the plate 18 to the dissipative portion 46 of the plate 18. As shown in FIGS. 3 and 3A, this dissipative portion 46 is substantially parallel to the inward slope 16 of the frame 14. Alternatively, the dissipative portion 46 can be substantially parallel to a plane defined by the lens 34, as shown in FIGS. 7 and 7A. In one embodiment, the dissipative portion of the plate 46 and the plate 18 can be separate, non-contiguous pieces. Heat is also carried through the plate 18 to the housing 22 by conduction at contact 40. However, in other embodiments, the heat is transferred by convection or radiation to the housing. In turn, heat is carried through the housing 22 to the fixing mechanism 30 at the point of contact 41. In various embodiments, more points of thermal communication can be added to increase heat dissipation. For example, an embodiment can have, but is not limited to having, another dissipative portion in thermal communication with the plate. Once this heat has been carried to other parts of the heat dissipation system of the lighting apparatus 10, the heat is transferred to the surrounding environment of the lighting apparatus 10 through convection and/or radiation.

The present disclosure contemplates varying the angle of the dissipative portion 46 to control direction of heat radiation. As shown in FIGS. 3 and 3A, the dissipative portion 46 can be substantially parallel to an inward slope 16 of the frame 14. In this configuration, the outside surface of the dissipative portion 46 radiates heat downward and away from the light source. Because hot air rises, and correspondingly cooler air is presumably below the light when illuminating downward, placing the outside surface of the dissipative portion at a downward angle ensures that it is in contact with cool surroundings and directing radiation toward cooler locations. Because greater radiation occurs with greater temperature differential, it is desirable to place the outer surface of the dissipative portion 46 in a manner to maximize this differential. In alternative embodiments, the dissipative portion 46 can be placed at varying angles so as to take advantage of the particular surroundings and to maximize this temperature differential, as will be contemplated by one skilled in the art.

Referring now to FIG. 4, another embodiment of a lighting apparatus 10' is shown and described. In this embodiment, the lighting apparatus 10' includes a frame 14', a plate 18', a housing 22', a light source 26', a fixing mechanism 30', a lens 34', and a light element 38'. The frame 14' and plate 18' have a rectangular form. In various embodiments, the frame 14' and plate 18' can take any shape, as described above. The fixing mechanism 30' has an axis that is parallel to the plate 18'. As described above, the materials and configuration of the various components can vary, thus all the possible combination are not repeated.

Figure 5:
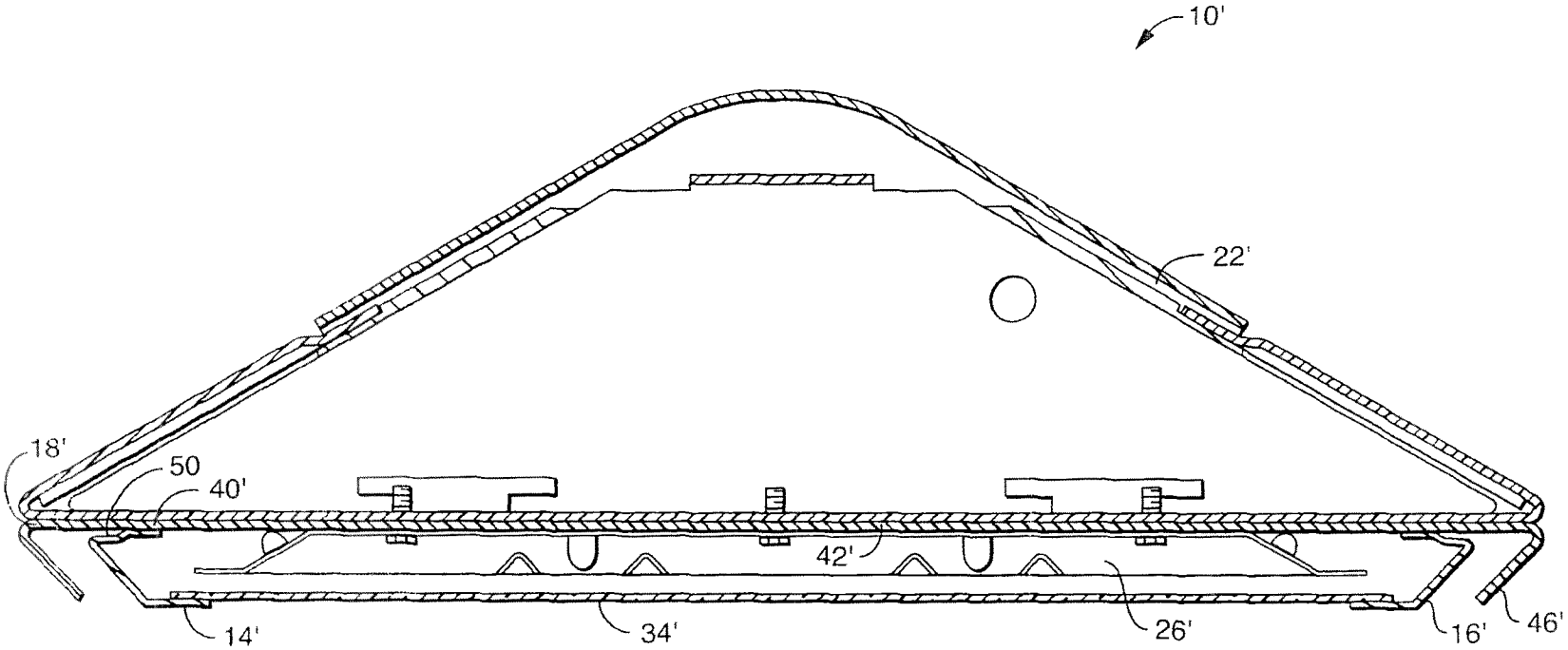
FIG. 5 shows a cross-sectional view of the lighting apparatus of FIG. 4.
Figure 5A:
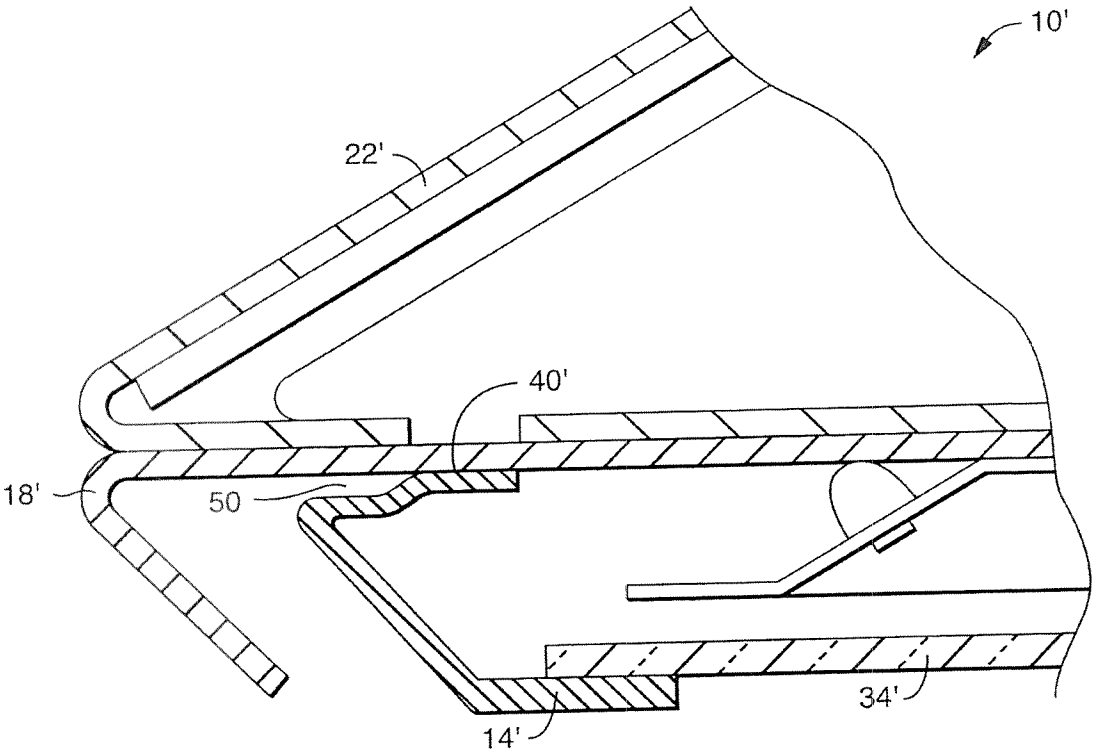
FIG. 5A shows an enlarged, detailed view of a portion of FIG. 5.

Referring now to FIG. 5, a cross-sectional view of the lighting apparatus 10' of FIG. 4 is shown and described. The lighting apparatus 10' includes a frame 14', a plate 18', a light source 26', a light element 38', a housing 22', a PCB 42', a lens 34', and an offset gap 50. As shown, this embodiment differs from the lighting apparatus 10 of FIG. 1 by the inclusion of the offset gap 50 formed by the frame 14 rather than the plate 18. This offset gap 50 allows for, in various embodiments, a gasket, an adhesive, a polyurethane, or other material to cooperate to form thermal communication between the various components. With this offset gap 50 and point of contact 40', the shown embodiment permits the use of, but is not limited to, a gasket or other sealant to seal against, for example, moisture ingress, while also preserving direct contact 40' between the frame 14' and the plate 18'.

Figure 6:
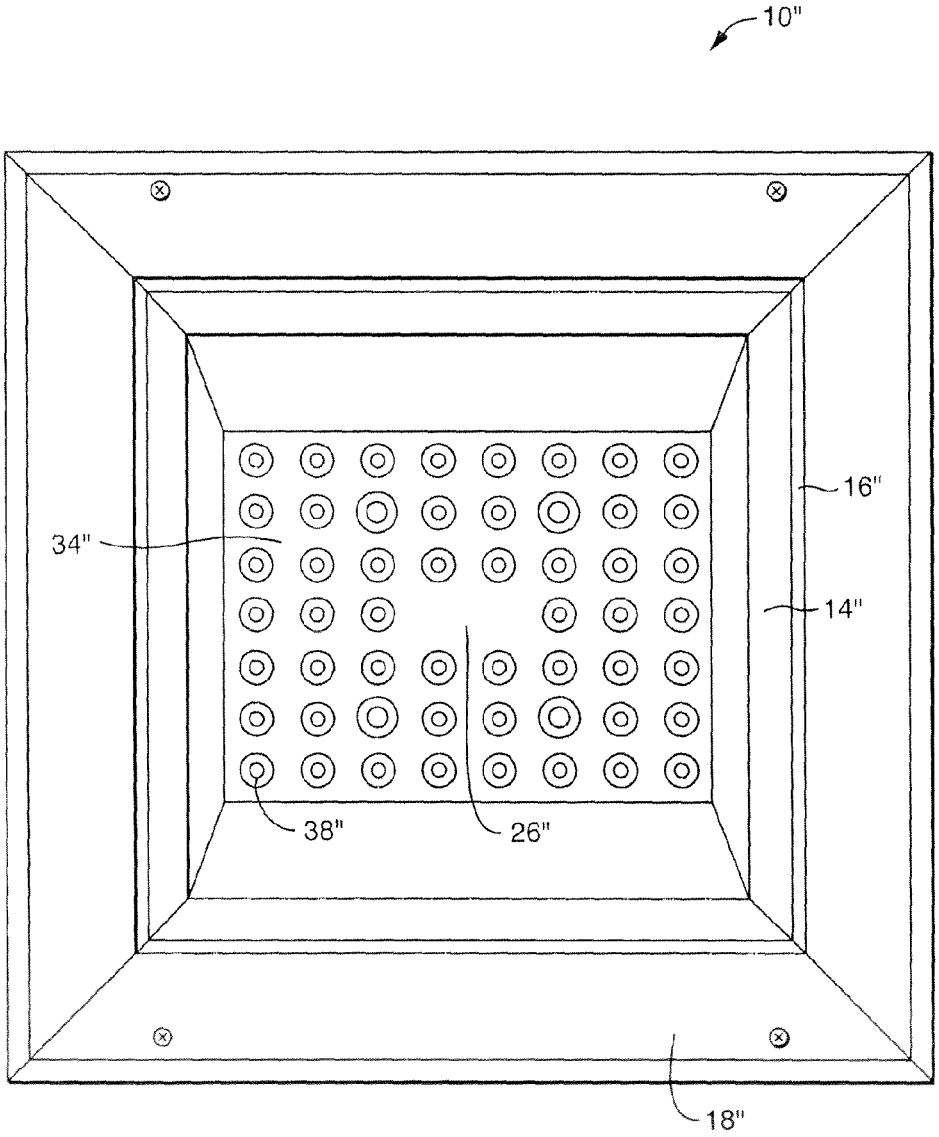
FIG. 6 shows a bottom view of another embodiment of a lighting apparatus.

Referring now to FIG. 6, another embodiment of a lighting apparatus 10" is shown and described. The lighting apparatus 10" includes a frame 14", a plate 18", a light source 26" including a plurality of light elements 38", and a lens 34". The frame 14" is in thermal communication with the light source 26" and with the plate 18". The plate 18" is in thermal communication with the light source 26" via the frame 14".

Referring now to FIG. 7, a cross-sectional view of the lighting apparatus 10" of FIG. 6 is shown and described. The frame 14" is in thermal communication with the plate 18" and the housing 22". The frame 14" has a point of contact 60 with the plate 18". The thermal communication is achieved by the gravitational pull of the frame 14" onto the plate 18", but may be augmented in other manners such as, by way of example only, screws, latches, fasteners, adhesives, springs, clips, or other mechanisms. In this embodiment, the inward slope 16" of the frame 14" shares a point of contact with a sloped portion of plate 18". In such a configuration, heat can be transferred from the light source 26" to the frame 14" through conduction. The heat can also be transferred from the frame 14" to the housing 22" and the plate 18" through conduction. Using convection and radiation, heat can be transferred to the environment surrounding the lighting apparatus 10" through the frame 14", housing 22", a dissipating portion 46" of the plate 18", and through other materials in thermal communication with the light source 26". Radiation is also directed downward from the dissipating portion 46" of plate 18".

Although various embodiments are shown and described above, it should be understood other various modifications can also be made. For example, the materials used to construct the thermal conductive elements of the lighting apparatus can be constructed of sheet metal. In other embodiments, other materials such as gold, silver, aluminum, stainless steel, or other materials can be used. For example, ASTM: Aluminum 3003 H14 can be used. Of course, various combinations of one or more materials can also be used. Also, although most of the components are shown as being relatively smooth, it should be understood that they can be textured, contoured, undulated, painted, or otherwise non-flat or otherwise modified to increase or decrease their thermal transfer properties. Also, in various embodiments of the present disclosure, the plate 18,18',18" or the dissipative portion of the plate 46,46',46" is at least partially observable by an ordinary observer of the light in its normal operation. In one embodiment, an observer whose view is perpendicular to the plane created by the lens 34, frame 14, or plate 18 can observe, in plain view, at least a portion of the plate 18,18',18" or a dissipative portion of the plate 46,46',46".

While the disclosure makes reference to the details of preferred embodiments, it is to be understood that the disclosure is intended in an illustrative rather than in a limiting sense, as it is contemplated that modifications will readily occur to those skilled in the art, within the spirit of the disclosure and the scope of the appended claims.

We claim:

1. A luminaire comprising:

a frame having a rear side and a front side, the front side defining an aperture;

a light source adjacent to the rear side and configured such that light emitted from the light source passes through the aperture defined by the frame; and a dissipative portion extending from adjacent the rear side of the frame to a distal end adjacent the front side of the frame, and the dissipative portion having first and second opposing sides exposed to the ambient air.

2. The luminaire of claim 1 wherein the light source comprises one or more light emitting diodes.

3. The luminaire of claim 1 wherein the luminaire further comprising a lens extending across the aperture enclosing the light source, but not the dissipative portion.

4. The luminaire of claim 1 wherein the frame and dissipative portion are constructed of sheet metal.

5. The luminaire of claim 1 further comprising a plate connected to the frame and in thermal communication with the light source.

6. The luminaire of claim 5 wherein the dissipative portion is an extension of the plate.

7. The luminaire of claim 1 being configured to direct light generally in a first direction and the dissipative portion extending generally at least partially in the first direction.

8. The luminaire of claim 1, the frame having an outer perimeter circumscribing the light source.

9. The luminaire of claim 1, the frame having an outer perimeter and the dissipative portion extends adjacent to the frame outer perimeter.

10. The luminaire of claim 1, the frame having an outer perimeter and the dissipative portion extends parallel to the frame outer perimeter.

11. A luminaire comprising:

a frame defining an aperture;

a light source, wherein light emitted from the light source passes through the aperture defined by the frame;

a dissipative portion extending from the frame at a proximal end to a distal end to define a volume bounded at the perimeter by the dissipative portion and extending from the proximal end of the dissipative portion to the distal end of the dissipative portion; and the light source within the volume defined by the dissipative portion.

12. The luminaire of claim 11 wherein the light source comprises one or more light emitting diodes.

13. The luminaire of claim 11 further comprising a lens spanning the aperture and enclosing the light source, but not the dissipative portion.

14. The luminaire of claim 11 wherein the frame is constructed of sheet metal.

15. The luminaire of claim 11 further comprising a plate connected to the frame and in thermal communication with the light source.

16. The luminaire of claim 15 wherein the dissipative portion is an extension of the plate.

17. The luminaire of claim 11 the dissipative portion surrounding the frame.

18. The luminaire of claim 11, the frame having an outer perimeter and the dissipative portion extends adjacent to the frame outer perimeter.

19. The luminaire of claim 11, the frame having an outer perimeter and the dissipative portion extends parallel to the frame outer perimeter.

20. A luminaire comprising:

a frame having a rear side and a front side, the front side defining an aperture;

a light source, wherein light emitted from the light source passes through the aperture defined by the frame;

a dissipative portion extending from adjacent the rear side of the frame to a distal end located adjacent the front side of the frame; and a lens spanning the aperture defined by the frame and enclosing the light source, but not the dissipative portion, within the frame.

21. The luminaire of claim 20 wherein the light source comprises one or more light emitting diodes.

22. The luminaire of claim 20 further comprising a plate connected to the frame and in thermal communication with the light source.

23. The luminaire of claim 22 wherein the dissipative portion is an extension of the plate.

24. The luminaire of claim 20 wherein the dissipative portion partially circumscribes the frame.

25. The luminaire of claim 20 wherein the dissipative portion is constructed of sheet metal.

26. The luminaire of claim 20, the frame having an outer perimeter and the dissipative portion extends adjacent to the frame outer perimeter.

27. The luminaire of claim 20, the frame having an outer perimeter and the dissipative portion extends parallel to the frame outer perimeter.

28. A luminaire comprising:

a frame having a rear side and a perimeter wall extending from the rear side to a front side of the frame, the front side of the frame defining an aperture;

a light source within the frame configured such that light emitted from the light source passes through the aperture;

a plate extending outward from the rear side of the frame to a luminaire outer perimeter; and a dissipative portion extending from the plate at the luminaire outer perimeter toward the front side of the frame to a distal end of the dissipative portion.

29. The luminaire of claim 28, the plate extending outward from the rear side of the frame in a direction parallel to the rear side of the frame.

30. The luminaire of claim 28, the dissipative portion extending parallel to the frame perimeter wall from the luminaire outer perimeter to the distal end.

31. The luminaire of claim 29, the dissipative portion extending parallel to the frame perimeter wall from the luminaire outer perimeter to the distal end.

32. The luminaire of claim 28 wherein the dissipative portion partially circumscribes the frame.

33. The luminaire of claim 28 wherein the dissipative portion fully circumscribes the frame.

34. The luminaire of claim 28 further comprising a reflector associated with the light source to reflect light emitted from the light source.

35. The luminaire of claim 28 the dissipative portion defining a volume bounded by the dissipative portion and extending from the luminaire outer perimeter to the distal end of the dissipative portion, and the light source is within the volume.

36. The luminaire of claim 28 further comprising a lens spanning the aperture defined by the frame and enclosing the light source, but not the dissipative portion, within the frame.

37. The luminaire of claim 28, the dissipative portion having first and second opposing sides exposed to the ambient air.

* * * * *